US005834681A

United States Patent [19]

DuBay

[11] Patent Number: 5,834,681

[45] Date of Patent: Nov. 10, 1998

[54] RELOADABLE HIGH-LOW PRESSURE AMMUNITION CARTRIDGE

[75] Inventor: David K. DuBay, Casper, Wyo.

[73] Assignee: Defense Technology Corporation of America, Casper, Wyo.

[21] Appl. No.: 878,834

[22] Filed: Jun. 20, 1997

[51] Int. Cl.[6] ..... F42B 5/02

[52] U.S. Cl. ..... 102/430; 102/447; 102/448; 102/469

[58] Field of Search ..... 102/334, 370, 102/430, 439, 444–447, 448, 464–470, 530, 531

[56] References Cited

U.S. PATENT DOCUMENTS

| | | | |
|---|---|---|---|
| H114 | 8/1986 | Quintavalle | 102/513 |
| 2,014,367 | 9/1935 | Breegle | 102/439 |
| 3,089,420 | 5/1963 | Littleford | 102/470 |
| 3,404,598 | 10/1968 | Angelos | 102/530 |
| 3,431,852 | 3/1969 | Fowler | 102/334 |
| 3,707,918 | 1/1973 | Dunfee et al. | 102/370 |
| 3,818,834 | 6/1974 | Baumgartener | 102/464 |
| 3,906,859 | 9/1975 | Smith | 102/444 |
| 3,983,817 | 10/1976 | Tucker | 102/334 |
| 4,478,150 | 10/1984 | Sayler et al. | 102/430 |
| 4,938,146 | 7/1990 | Gunther et al. | 102/439 |
| 5,016,536 | 5/1991 | Brighton | 102/444 |
| 5,086,703 | 2/1992 | Klein | 102/439 |
| 5,309,842 | 5/1994 | Matysik et al. | 102/447 |
| 5,359,937 | 11/1994 | Dittrich | 102/430 |
| 5,402,729 | 4/1995 | Richert | 102/439 |

FOREIGN PATENT DOCUMENTS

| | | | |
|---|---|---|---|
| 103509 | 3/1984 | European Pat. Off. | 102/502 |
| 2220467 | 1/1990 | United Kingdom | 102/447 |

*Primary Examiner*—Harold J. Tudor
*Attorney, Agent, or Firm*—Renner, Otto, Boisselle & Sklar, P.L.L.

[57] ABSTRACT

A high-low pressure ammunition cartridge includes a case containing a gas expansion chamber and a missile chamber separated from each other by a pressure containment wall containing one or more pressure control ports providing fluid communication between the gas expansion chamber and the missile chamber. The gas expansion chamber is located between the pressure containment wall and a base plate pressed into the back end of the case. The pressure containment wall may either be integral with the case or a separate piece which is removable from the case along with the base plate to facilitate reloading of the cartridge thereby reducing the cost of using the cartridge. The thickness of the base plate may be varied for varying the volume of the gas expansion chamber. Also, the thickness of the gas containment wall and number and size of holes in the gas containment wall may be varied for varying the velocity of the gas entering the missile chamber from the gas expansion chamber.

33 Claims, 1 Drawing Sheet

RELOADABLE HIGH-LOW PRESSURE AMMUNITION CARTRIDGE

FIELD OF THE INVENTION

This invention generally relates to ammunition cartridges for small, medium or large caliber arms that are adapted to use high pressure smoke free chemical explosives to propel missiles from the barrel of a gun at a precisely controlled exit velocity.

BACKGROUND OF THE INVENTION

Explosive propellants are widely used for ammunition for guns primarily designed for lethal applications. There is a need for ammunition for training and controlled lethality applications for police and military use such as the disbursement or routing of individuals in crowd control or civil disobedience situations which provides for more precise control of the velocity of the missiles.

Black powder is commonly used as a gas generating chemical for these applications. However, the use of black powder propelled rounds has the disadvantage that large volumes of smoke are emitted from the gun, obscuring the vision of the shooter. Also, black powder fouls the gun and creates difficult and expensive cleaning problems. Moreover, the charge volume of black powder propellant is difficult to control in order to provide the small variation of missile velocity required for controlled lethality use at subsonic speeds.

Various attempts have been made to use smoke free high explosive chemical propellants for these applications. High explosive chemicals require containment to produce efficient burning of the chemical and thereby the high pressure gas for propulsion of the missiles. However, such high pressure gas is too aggressive to use directly for less lethal applications because less lethal missiles are by nature of their use delicate in construction consisting often of wood, rubber foam, rubber balls and composite constructions which are damaged by the high pressure gas.

SUMMARY OF THE INVENTION

The present application relates to certain improvements in high-low pressure ammunition cartridges that use high pressure contained chemical explosives to create reliable quantities of high pressure gas and provide for the controlled release of the gas to propel the missiles at a predetermined velocity. Also, the cartridges of the present invention are desirably constructed in such a manner as to allow the cartridges to be reloaded thereby reducing the cost of using the cartridges.

In accordance with one aspect of the invention, such high-low pressure cartridges include one or more gas control ports in a protective wall between a gas expansion chamber at a rear section of the cartridge case and a missile chamber at a front section of the case for releasing low pressure gas into the missile chamber at a controlled rate for providing greater control of the exit velocity of the missiles from a barrel of a gun.

In accordance with another aspect of the invention, the gas expansion chamber is formed between a base plate at the back end of the case and the protective wall.

In accordance with another aspect of the invention, both the base plate and protective wall may be removable from the case to facilitate cleaning and reloading of the cartridge.

In accordance with another aspect of the invention, a gas sealing wad or sabot is placed between the gas expansion chamber and missile chamber to ensure the efficient use of the propellant gas and greater control over the exit velocity of the missile from the barrel.

In accordance with another aspect of the invention, a friction reducing wrapping surrounds the missiles when loaded in the missile chamber to provide a consistent level of friction between the missiles and gun barrel thus producing greater control over the exit velocity of the missiles from the barrel.

In accordance with another aspect of the invention, the velocity of the missiles can be precisely controlled in various ways, for example, by varying the amount of chemical explosive used, the volume of the gas expansion chamber, and/or the number, diameter and/or length of the gas control ports in the protective wall.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

DETAILED DESCRIPTION OF THE PREFERRED EMBODIMENTS

Figure 1:
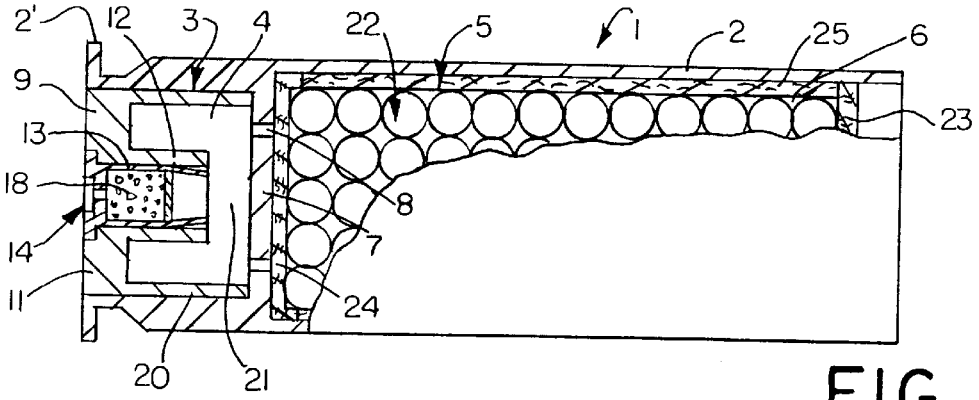
FIG. 1 is a fragmentary longitudinal section through one form of high-low pressure ammunition cartridge in accordance with the present invention.

Referring now in detail to the drawings, and initially to FIG. 1, one form of high-low pressure ammunition cartridge in accordance with this invention is generally indicated by the reference numeral 1 and includes a tubular case 2 having a rear section 3 containing a gas expansion chamber 4 and a front section 5 containing a missile chamber 6. Intermediate the gas expansion chamber 4 and missile chamber 6 is a pressure containment wall 7 containing one or more gas control ports 8. Pressed into the rearwardmost end of the rear section 3 is a base plate 9. Extending radially outwardly from the back end of the case 2 is an external rim 2'.

In the embodiment shown in FIG. 1 the pressure containment wall 7 is an integral part of the case 2, being made in one-piece as illustrated. However, preferably the pressure containment wall 7 is a separate disk or washer 10 (see FIG. 2) which allows the wall 7 and base plate 9 to be removed so the cartridge 1 can be reloaded as described hereafter in order to reduce the cost of using the cartridge. The case 2, pressure containment wall 7 and base plate 9 may be made of any suitable metal such as aluminum.

In either case, (e.g., whether the pressure containment wall is integral with the case or a separate component), the base plate 9 generally comprises a back wall 11 having an axially forwardly extending central hub portion 12 containing a stepped opening 13 for receipt of either a conventional cartridge blank 14 of any desired caliber or a suitable holder 15 (shown in FIG. 9) for a gas generating chemical.

Figure 8:
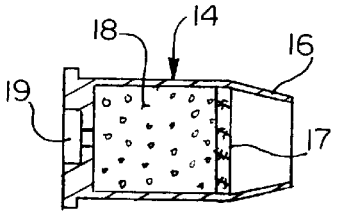
FIGS. 8 and 9 are longitudinal sections through a conventional form of cartridge blank and a separate holder, respectively, each with mechanical closures for a high explosive chemical propellant for use with the ammunition cartridge of the present invention.
Figure 9:
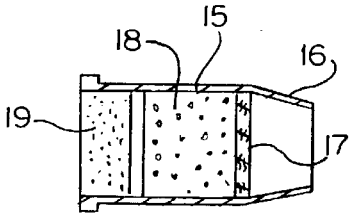

As shown in FIGS. 8 and 9, the blank 14 or holder 15 includes a mechanical closure 16 at one end such as a crimp closure for mechanically securing a wad 17 in the blank cartridge or holder for containing the gas generating chemical 18. Any gas generating chemical suitable for this particular application could be used as the propellant, including black powder. However, because of the pressure containment provided by the pressure containment wall 7 of the cartridge 1 of the present invention, a smoke free high explosive chemical powder 18 of known type is preferably used. The pressure containment wall 7 ensures that all of the smoke free powder is burned when ignited by a mechanically or electrically initiated explosive primer 19 of known type to produce reliable quantities of high pressure gas that expand into the gas expansion chamber 4 before passing through one or more gas control ports 8 in the pressure containment wall 7 into the missile chamber 6.

By varying the amount of chemical explosive 18 in the cartridge blank 14 or holder 15 or by varying the volume of the gas expansion chamber 4 and/or number, size, and/or length of the gas control ports 8 in the pressure containment wall 7, precise control of the missile velocity can be achieved for police and military use for training and less lethal applications such as the disbursement or routing of individuals in crowd control or civil disobedience situations and against individuals who offer violent resistance. Also the amount of chemical explosive used can be predetermined to ensure that when the cartridge is fired, the noise level at the shooter's ear will be kept below 140 decibels for use for example during training.

Figure 6:
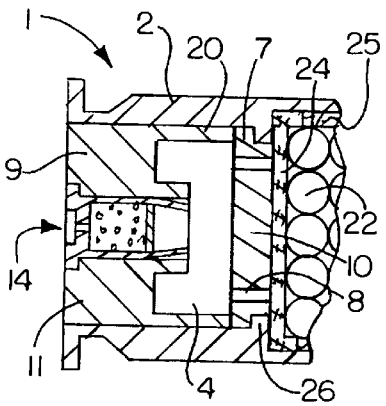
FIGS. 6 and 7 are fragmentary longitudinal sections through a cartridge similar to FIG. 2 except that the thickness of the back wall of the base plate has been increased in FIG. 6 and the thickness of the cylindrical side wall of the base plate and thickness of the pressure containment wall and diameter of the gas control ports have been increased in FIG. 7 to reduce the volume of the gas expansion chamber and rate of gas flow from the gas expansion chamber into the missile chamber.
Figure 7:
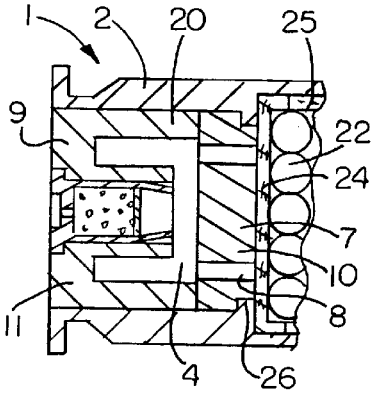

The volume of the gas expansion chamber 4 may be varied for example by varying the thickness of the back wall 11 of the base plate 9 or the thickness and/or length of the cylindrical side wall 20 of the base plate 9 which extends forwardly from the outer periphery of the back wall 11 into contact with the pressure containment wall 7. FIG. 6 shows a cartridge 1 in which the thickness of the back wall 1 1 of the base plate 9 is greater than that shown in FIGS. 1 and 2, whereas FIG. 7 shows a cartridge 1 in which the side wall 20 is thicker and shorter than that shown in FIGS. 1 and 2. Of course, the side wall 20 of the base plate 9 must have a minimum length somewhat greater than the length of the hub portion 12 to provide a minimum amount of head space 21 between the inner end of the hub portion and the pressure containment wall 7 so as not to interfere with the expansion of the high pressure gas into the gas expansion chamber 4 when the chemical propellant 18 is ignited by the mechanically or electrically initiated explosive primer 19 as aforesaid.

Figure 3:
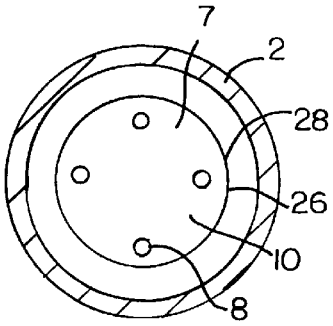
FIG. 3 is a transverse section through the cartridge of FIG. 2 showing a plurality of gas control ports in a pressure containment wall intermediate the gas expansion chamber and missile chamber of the cartridge.
Figure 4:
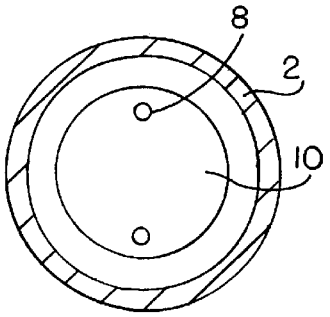
FIGS. 4 and 5 are transverse sections similar to FIG. 3 but showing different numbers of gas control ports in the pressure containment wall.
Figure 5:
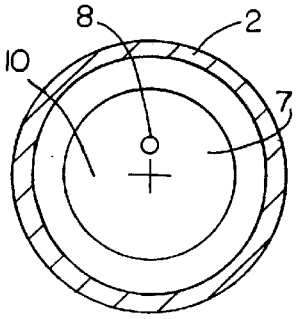

Any desired number of gas control ports 8 may be provided in the pressure containment wall 7. FIG. 3 shows four such gas control ports, whereas FIGS. 4 and 5 show two and one such gas control ports, respectively, in the pressure containment wall. Where more than one gas control port is provided, such gas control ports should be equally spaced around the periphery of the pressure containment wall 7 to provide for better distribution of the gas entering the missile chamber 6 through the gas control ports for propelling the missile from the case 2. Where only one such gas control port 8 is provided, such gas control port is preferably located slightly off center as schematically shown in FIG. 5 so that the initial blast of pressure created by burning of the propellant will hit the pressure containment wall and be deflected back into the gas expansion chamber 4 rather than be directed straight through the gas control port 8 into the missile chamber 6.

To vary the diameter and/or length of the gas control ports 8, disks or washers 10 of different thicknesses and/or hole diameters may be provided as desired. FIG. 7 shows one such disk 10 having a greater thickness and hole diameter than the disks shown in FIGS. 1, 2 and 6. Of course, as the thickness of the disk 10 increases, the length of the side wall 20 of the base plate 9 must be correspondingly reduced for a given size case 2 which also reduces the volume of the expansion chamber 4.

Depending on the particular base plate and/or disk that is used with a given size case, precise control of the exit velocity of different types of missiles from the barrel of a gun can be achieved. For example, the missiles may comprise one or more bean bags or batons made out of various materials such as wood, rubber, rubber foam, and composite constructions. Each of these missiles requires a different volume of gas for propelling the missiles at a desired exit velocity.

Figure 2:
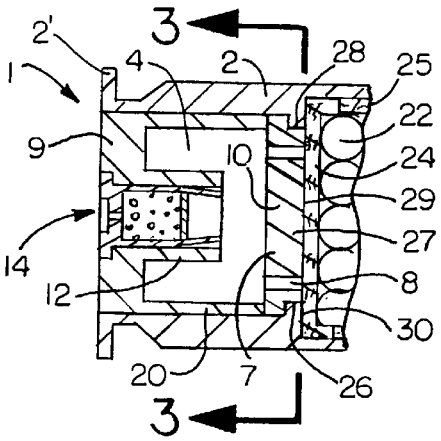
FIG. 2 is a fragmentary longitudinal section through another form of high-low pressure ammunition cartridge in accordance with this invention.

FIGS. 1, 2, 6 and 7 show one such missile 22 as comprising a plurality of rubber balls loaded into the missile chamber 6 and held in place by a suitable wad 23 such as a plastic or cardboard disk press fitted into the front end of the case 2. Between the gas expansion chamber 4 and missile chamber 6 (e.g., between the expanding gas propellant 18 and the missile 22) at the rear end of the gas expansion chamber is a gas sealing wad or sabot 24 to ensure the efficient use of the propellant gas and greater control over the exit velocity of the missile from the barrel. Also, a frictional reducing insert or wrapping 25 made for example of fiber desirably surrounds the missile when loaded in the cartridge case. The wrapping 25 is propelled through the barrel with the missile and produces a more consistent friction level between the missile/projectile and barrel thus providing greater control of the exit velocity of the missile from the barrel.

Where the pressure containment wall 7 is a separate disk or washer 10, an internal shoulder 26 is provided in the case 2 having a radially inwardly extending rear face that acts as a stop for the disk when pressed into the back end of the case before the base plate 9 is pressed in place. Axially spaced from the rear face is a radially inwardly extending front face 30 of the shoulder 26. Extending through the shoulder 26 between the rear and front faces is a reduced opening 28. Preferably the disk 10 has a stepped cylindrical end 27 that is pressed into the reduced opening 28 defined by the shoulder 26. The stepped end 27 has an outer diameter and length substantially corresponding to the diameter of the opening 28 and thickness of the shoulder 26 so that the front end face 29 of the stepped end 27 26 is flush with the front face 30 of the shoulder as schematically shown in FIGS. 2, 6 and 7.

Making the pressure containment wall a separate component not only allows disks 10 of different thicknesses and different numbers and diameters of gas control ports 8 to be used with a given size case 2, but also allows the pressure containment wall 7 and base plate 9 to be pressed out of the case after firing the cartridge for ease of cleaning and reloading the cartridge thereby reducing the cost of using the cartridges. If the pressure containment wall 7 is integral with the case as depicted in FIG. 1, it is much more difficult to remove the base plate 9 for reloading. However, it is still possible to reload the cartridge 1 by gripping the cartridge blank 14 or holder 15 and pulling it out, then blowing out the gas expansion chamber 4 through the opening 13 in the base plate, and finally pressing a new blank 14 or holder 15 into the opening 13. Also, the blanks 14 or holders 15 need not be pressed into the cartridges 1 until readied for use, thus making it safer and less expensive to ship and store the cartridges without the blanks 14 or holders 15.

Although the invention has been shown and described with respect to certain preferred embodiments, it is obvious that equivalent alterations and modifications will occur to others skilled in the art upon the reading and understanding of the specification. The present invention includes all such equivalent alterations and modifications, and is limited only by the scope of the claims.

What is claimed is:

1. A high-low pressure ammunition cartridge comprising a case containing a gas expansion chamber at a rear section of said case and a missile chamber at a front section of said case, a plurality of base plates any one of which are removably connected to a rear end of said case, each of said base plates containing an opening for receiving an explosive propellant which when burned produces a high pressure gas that is released into said gas expansion chamber, said base plates having different wall thicknesses for selective use of said base plates with a given size case for varying the volume of said gas expansion chamber within said case, a pressure containment wall intermediate said gas expansion chamber and said missile chamber, and at least one gas control port extending through said pressure containment wall for controlling the velocity of the gas entering said missile chamber from said gas expansion chamber for propelling missiles from said missile chamber at a controlled velocity.

2. The cartridge of claim 1 wherein said base plates have back walls of different wall thicknesses for selective use of said base plates with a given size case for varying the volume of said gas expansion chamber within said case.

3. The cartridge of claim 1 wherein said base plates have outer sleeves of different wall thicknesses that press up against said pressure containment wall for selective use of said base plates with a given size case for varying the volume of said gas expansion chamber within said case.

4. The cartridge of claim 1 wherein the base plate that is removably connected to said case is press fitted into said rear end of said case.

5. The cartridge of claim 1 further comprising a gas seal between said gas expansion chamber and said missile chamber.

6. The cartridge of claim 1 wherein said explosive propellant is a smoke free high explosive chemical propellant contained in said opening in the back wall of the base plate that is removably connected to said case.

7. The cartridge of claim 6 wherein said explosive propellant is contained in a cartridge blank pressed into said opening in said back wall, said cartridge blank having a mechanical closure for said explosive propellant.

8. The cartridge of claim 6 wherein said explosive propellant and a primer are contained in a holder pressed into said opening in said back wall.

9. The cartridge of claim 1 wherein said gas containment wall and said case are one-piece.

10. The cartridge of claim 1 wherein said gas containment wall comprises a separate disk that is removably received in said case from said rear end before the base plate is removably connected to said case, said case having an internal shoulder providing a stop for said disk.

11. The cartridge of claim 10 wherein any one of a plurality of separate disks having different numbers of gas control ports are removably connected to said case to provide for selective use of said disks with a given size case.

12. The cartridge of claim 10 wherein any one of a plurality of separate disks having different diameter gas control ports are removably connected to said case to provide for selective use of said disks with a given size case.

13. The cartridge of claim 1 wherein a plurality of cartridge blanks containing different amounts of said explosive propellant are provided for selective use with a given size case.

14. The cartridge of claim 1 wherein said pressure containment wall contains a plurality of gas control ports.

15. A high-low pressure ammunition cartridge comprising a case containing a gas expansion chamber at a rear section of said case and a missile chamber at a front section of said case, a base plate at a rear end of said case, said base plate containing an opening for receiving an explosive propellant which when burned produces a high pressure gas that is released into said gas expansion chamber, a pressure containment wall intermediate said gas expansion chamber and said missile chamber, and at least one gas control port extending through said pressure containment wall for controlling the velocity of the gas entering said missile chamber from said gas expansion chamber for propelling missiles from said missile chamber at a controlled velocity, said base plate being removably connected to said rear end of said case, and said gas containment wall comprising a separate disk that is removably received in said case from said rear end before said base plate is removably connected to said case, said case having an internal shoulder providing a stop for said disk, and said base plate having an outer sleeve that is pressed up against said disk when said base plate is removably connected to said case and said disk is pressed up against said stop to maintain said disk in engagement with said stop.

16. The cartridge of claim 15 wherein said shoulder has a radially inwardly extending rear face that provides said stop for said disk and a radially inwardly extending front face axially spaced from said rear face, said shoulder having an opening extending between said rear and front faces in which a stepped end of said disk is received.

17. The cartridge of claim 16 wherein said stepped end of said disk is flush with said front face of said shoulder.

18. The cartridge of claim 15 wherein any one of a plurality of separate disks of different thicknesses are removably received in said case to provide for selective use of said disks with a given size case for varying the length of said gas control ports in said disks, and any one of a plurality of base plates having different length outer sleeves that press up against said disks are removably connected to said case to provide for selective use of said base plates with different thickness disks for varying the volume of said gas expansion chamber within a given size case.

19. The cartridge of claim 15 wherein any one of a plurality of separate disks having different numbers of gas control ports are removably received in said case to provide for selective use of said disks with a given size case.

20. The cartridge of claim 15 wherein any one of a plurality of separate disks having different diameter gas control ports are removably received in said case to provide for selective use of said disks with a given size case.

21. A high-low pressure ammunition cartridge comprising a case containing a gas expansion chamber at a rear section of said case and a missile chamber at a front section of said case, a base plate removably connected to a rear end of said case, said base plate containing an opening for receiving an explosive propellant which when burned produces a high pressure gas that is released into said gas expansion chamber, a pressure containment wall intermediate said gas expansion chamber and said missile chamber, and at least one gas control port extending through said pressure containment wall for controlling, the velocity of the gas entering said missile chamber from said gas expansion chamber for propelling missiles from said missile chamber at a controlled velocity, said gas containment wall comprising a separate disk that is removably received in said case from said rear end before said base plate is removably connected to said case, said case having an internal shoulder intermediate said gas expansion chamber and said missile chamber, said internal shoulder including a radially inwardly extending rear face engaged by said disk to provide a stop for said disk, and a radially inwardly extending front face axially spaced from said rear face, and an opening extending through said shoulder between said rear and front faces in which a stepped end of said disk is received.

22. The cartridge of claim 21 wherein said stepped end of said disk is flush with said front face of said shoulder.

23. The cartridge of claim 21 wherein a plurality of cartridge blanks containing different amounts of highs explosive propellant are provided for selective use with a given size case.

24. The cartridge of claim 21 wherein said disk contains a plurality of gas control ports.

25. The cartridge of claim 24 wherein said disk has two such gas control ports diametrically opposite each other.

26. The cartridge of claim 24 wherein said disk has four such gas control ports equally spaced around said disk.

27. The cartridge of claim 21 wherein said disk contains a single gas control port which is located slightly off center of said disk.

28. The cartridge of claim 21 further comprising a friction reducing wrapping surrounding a missile in said missile chamber.

29. The cartridge of claim 28 wherein said wrapping is made of fiber.

30. The cartridge of claim 21 further comprising a missile in said missile chamber, a wad pressed into a front end of said case for retaining said missile within said missile chamber, and a gas seal between said pressure containment wall and said missile in said missile chamber.

31. The cartridge of claim 21 wherein said case and said pressure containment wall are made of aluminum.

32. The cartridge of claim 31 wherein said base plate is made of aluminum.

33. The cartridge of claim 21 wherein a predetermined amount of a smoke free high explosive chemical propellant is placed in said opening in said base plate such that when fired said cartridge produces a noise level of less than 140 decibels at the shooter's ear.

* * * * *